United States Patent [19]

Zeigler et al.

[11] 4,179,603

[45] Dec. 18, 1979

[54] RADIAL BLADE HEATING DEVICE

[75] Inventors: Jon G. Zeigler, Salem; Elmer L. Kerr, Damascus; David V. Bell, Hanoverton, all of Ohio

[73] Assignee: The Electric Furnace Company, Salem, Ohio

[21] Appl. No.: 853,274

[22] Filed: Nov. 21, 1977

[51] Int. Cl.[2] ..... H05B 3/02

[52] U.S. Cl. ..... 219/538; 13/22; 13/25; 219/408; 219/523; 219/536; 219/550; 219/552

[58] Field of Search ..... 219/408, 523, 531, 536, 219/537, 538, 539, 550, 552, 280, 381, 542, 411; 13/20, 22, 25, 31; 338/280, 289

[56] References Cited

U.S. PATENT DOCUMENTS

| | | | |
|---|---|---|---|
| 1,242,341 | 10/1917 | Fulton | 13/25 |
| 2,223,617 | 12/1940 | Johnston | 13/22 |
| 2,640,861 | 6/1953 | Kremers | 13/25 |
| 2,650,254 | 8/1953 | Kremers | 13/22 |
| 2,790,889 | 4/1957 | Hynes | 219/280 |
| 2,966,537 | 12/1960 | Witucki et al. | 13/22 |
| 3,004,090 | 10/1961 | Donovan et al. | 13/25 |
| 3,045,097 | 7/1962 | Sellers | 219/539 |
| 3,395,241 | 7/1968 | Roman | 13/25 |
| 3,571,566 | 3/1971 | Kuzara | 219/536 |
| 3,737,553 | 6/1973 | Kreider et al. | 13/25 |
| 3,984,616 | 10/1976 | Beck | 13/25 |
| 4,016,403 | 4/1977 | Best | 219/550 |

*Primary Examiner*—Volodymyr Y. Mayewsky
*Attorney, Agent, or Firm*—Meyer, Tilberry & Body

[57] ABSTRACT

An electric radial blade type heating element is provided for industrial furnaces or other heated devices in which the electrical conductors are relatively thin flat strips or blades, rectangular in cross section and free floating relative to the insulating support structure of the element. The conductors are arrayed in a radially diverging relationship to maximize the exposure of the radiating surfaces which minimizes the pocketing of released heat and overheating of the elements. Means are provided to pass a fluid over the conductors when the element is mounted within a radiant tube to reduce oxidation of the element and the interior surface of the radiant tube. The heating element support structure is not dependent on the conductors for strength or rigidity, thereby rendering the element equally suitable for vertical as well as horizontal installation. The element may be used to directly heat a furnace, or may be mounted in a radiant tube to heat the radiant tube. The number of radially arranged conductors in the array, their thicknesses and widths are functions of the heat release desired and, if used in a radiant tube, the diameter of the enclosing tube.

27 Claims, 11 Drawing Figures

RADIAL BLADE HEATING DEVICE

COMPARISON OF PRIOR ART WITH THE SUBJECT INVENTION

With the relatively recent advent of increased cost of gas and liquid fuels and continuing shortages of these fuels, users of industrial heated devices, such as furnaces, are looking for more efficient means to operate such devices, hereinafter referred to as "furnaces." As a consequence, gas and oil fired furnaces are now being converted to electric operation which is also cleaner, quieter and requires less maintenance. Thus, electric furnaces are now becoming more attractive, in spite of the fact that considerable room remains for improvement in the efficient application of electric heating elements.

The patent to Best U.S. Pat. No. 4,016,403 is the closest prior art known to applicants. However, unlike applicants' device, in Best the interconnection between the conductors maintains the support structure in assembly thereby increasing problems of thermal stress and creep, particularly in vertical installations. Additionally, the U-shaped rod type conductors of Best are more difficult and expensive to form, and to assemble than applicants' thin, flat rectangular blade-like conductors. Applicants are also aware of a prior art element in which the conductor is made from flat strip-like material, but the strip is helically wound, thereby rendering it quite dissimilar from applicants' linear conductors.

The subject radial blade heating element has many other advantages over prior art elements. Weight to length ratio of the subject heating element is lower than other units. This allows the use of the subject element in longer lengths for wider furnace hearth or deeper chamber configurations. Electrical stability is very good which allows the installation of a new heating element into a circuit with used elements without creating electrical imbalances. When used in a radiant tube, oxidation of the radiant tube and the heating element is minimized. Thermal energy release from the electric radiant tube is equivalent to that of a fuel fired radiant tube.

Two significant advantages available in the subject electric heating element are heat release and electrical design flexibility. This design provides for the maximum element radiating surface area exposure in a manner which minimizes the re-radiation of thermal energy back to the heating element, thus maintaining a lower element temperature. Improved element life is realized from this feature due to the increased ratio of surface area to the mass of the conductors. Lower watts release per unit of surface area may be obtained than with bulkier conductors for the same heat output. Temperature differentials between heating element and radiant tube are less, allowing higher tube temperatures for any given element temperature. Furthermore, the design of the subject invention provides wide circuitry variations without reduction of radiating surface area. Changes in element resistivity can be achieved by cross section variation of the element material with very little change in the exposed surface area. The array of conductors in each unit may be connected in single or multi-phase electrical circuits.

Further dissimilarities and novel features of applicants' invention over the noted prior art will now be more fully set forth and discussed hereinbelow.

Objects of the Invention

It is among the objects of this invention to provide an electric heating element in which: a more uniform heat distribution is provided over the length of a radiant tube; a longer useful life is obtained; the element is equally suitable for retro-fitting fuel fired furnaces and for installation in new furnace applications; the conductors of the element are configured and arrayed to maximize heat radiation radially outwardly from the element; change of resistance of conductors can be readily obtained with minimum change of conductor surface area; improved means are provided to interconnect ends of conductors to minimize undesirable heat liberation to the ends of a radiant tube; the conductors are free floating thereby minimizing thermal stress and creep; the support structure is not dependent on the conductors to maintain the support structure in assembly; heat release of the heating element is less restricted than in the congested designs of hairpin-type circular rods or helically wound flat strips; the conductors are only required to support their own weight; the weight to length ratio of the element allows for use in wider or deeper furnaces; the shape and alignment of conductors produces a fin-type means of heat dispersal at lower watts per unit of surface area to enhance element life; the element requires no special or additional end assembly of insulation means; the element is supported by a single structural member; the center support structure includes, if desired, means to introduce a fluid over the conductors of the heating element to minimize oxidation of the heating elements and the inner surface of a radiant tube; the support structure is integral and structurally separate from the conductors; the element parts are easier to manufacture, to assemble and to repair than the parts of prior art elements; manufacture of the element does not require bending of conductors; the conductors require fewer welds for the same electrical conductivity than hairpin-type circular rods; assembly is faster than elements with hairpin-type circular rod conductors because of the requirement for fewer conductors; spacers and insulators are resiliently sandwiched together concentrically about a central structural member to provide a support structure member to provide a support structure which does not use conductors for structural integrity; thin, flat, blade-like conductors provide greater element design flexibility; the element can be readily changed without shutting down the furnace; thermal energy release is substantially equivalent to that of a gas or liquid fuel fired radiant tube; the element assembly can be inserted directly into a furnace chamber or other heated device without being contained in a radiant tube; and in which: a small flow of air is directed about the element to minimize oxide deterioration of the heating element and of the radiant tube when the element is installed in a radiant tube.

Other objects, features and advantages of the invention will become apparent in light of the following detailed description of the preferred embodiment shown and described herein, and as illustrated in the accompanying drawings in which.

THE DISCLOSURE

Figure 1:
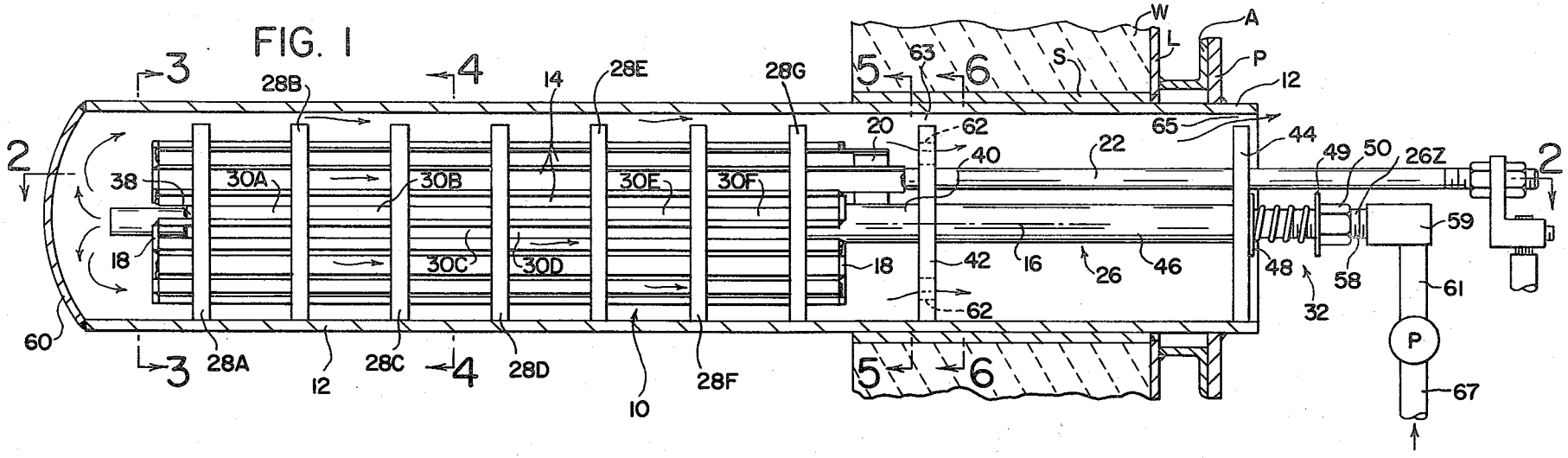
FIG. 1 is an elevational view of a preferred embodiment of the invention shown assembled in a radiant tube.
Figure 3:
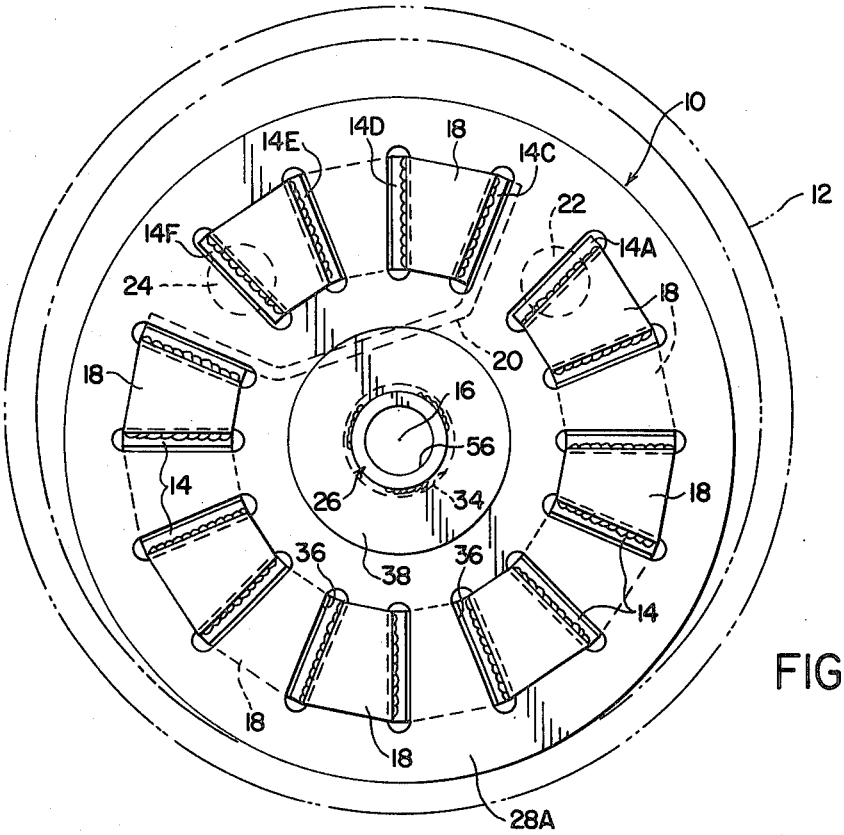
FIG. 3 is a view of the invention taken along the line 3—3 of FIG. 1.
Figure 4:
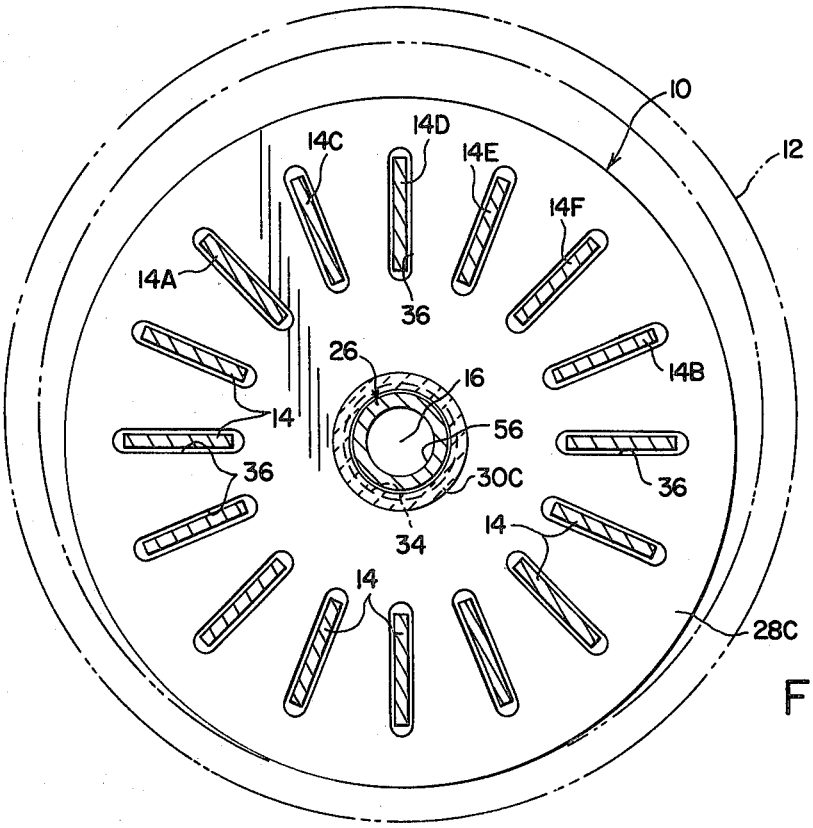
FIG. 4 is a view of the invention taken along the line 4—4 of FIG. 1.
Figure 5:
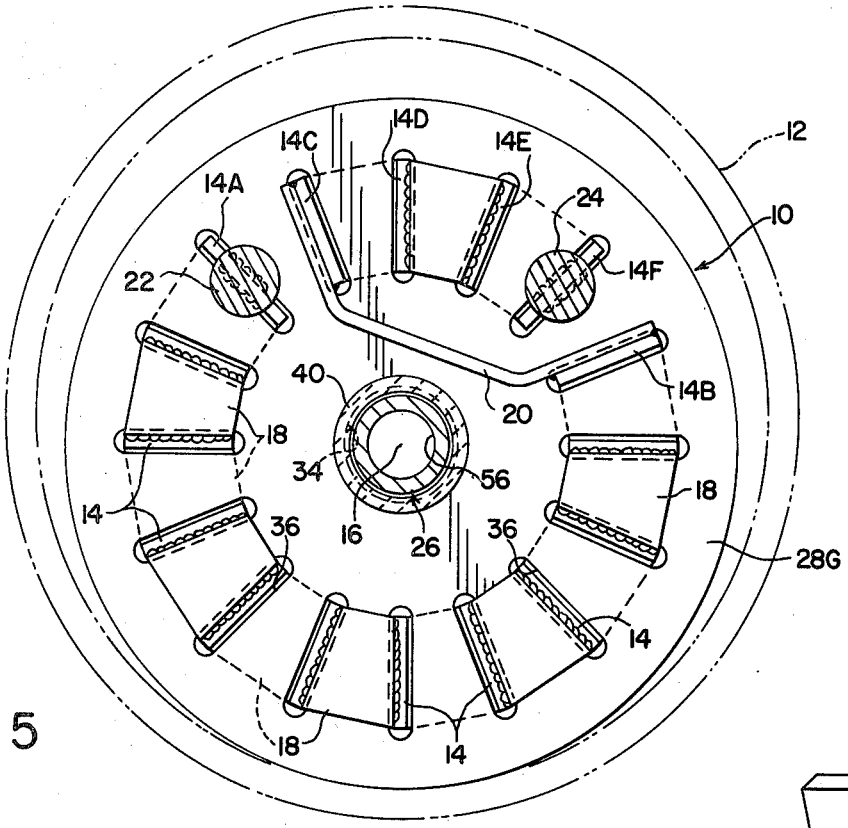
FIG. 5 is a view of the invention taken along the line 5—5 of FIG. 1.
Figure 11:
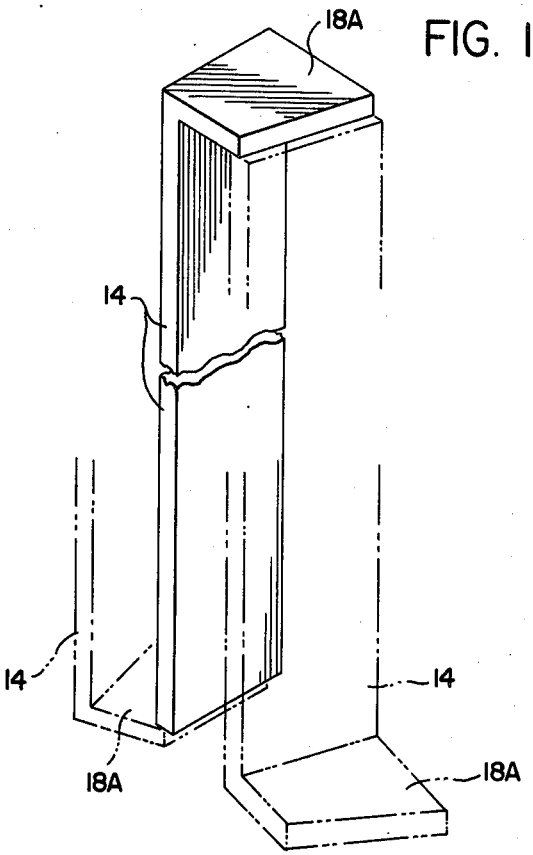

Referring first to FIG. 1, therein is shown a preferred embodiment of the invention 10 mounted within a radiant tube 12. The radiant tube 12 is secured in the wall W of a furnace by conventional means such as a sleeve S, spacer angle iron frame A welded to the furnace wall liner L and mounting flange P welded to radiant tube 12. The element comprises a plurality of conductors 14 which are radially arrayed about a central longitudinal axis 16 (FIGS. 3, 4 and 5). The conductors 14 are interconnected one to the other in electrical single or polyphase series by means of jumper plates 18 (FIGS. 2, 3 and 5) and jumper bar 20 (FIGS. 3 and 5). In lieu of jumper plates 18, the ends of the conductors can be formed to provide integral jumper means. Thus, as shown in FIG. 11, ends 18*a* may be formed on conductors 14 to act as jumpers to be welded to the straight ends of adjacent conductors 14. A terminal connector rod 22 is electrically fastened to a conductor 14A and a second terminal rod 24 is electrically fastened to a conductor 14F. So connected, current may flow counterclockwise from conductor 14A through the plurality of conductors generally indicated as 14 and jumper plates 18 until the conductor 14B is reached which is in turn connected to conductor 14C by jumper bar 20. The current then flows through conductors 14D, 14E and 14F and finally to terminal connector rod 24. Obviously, the current may also flow in a clockwise direction in which case the path of flow would be the opposite of the path just described, generally from terminal connector rod 24 clockwise to terminal connector rod 22. It is also obvious that other current flow circuits may be employed within the scope of the invention which are well understood by those skilled in the art, the above specifically described circuits having been set forth for illustrative purposes only.

The support structure for conductors 14 and terminal connector rods 22 and 24 comprises a central structural support column 26, preferably tubular and cylindrically shaped, (FIG. 1), a plurality of insulating discs 28A through 28G, 42 and 44, insulating spacers 30, 40 and 46 and insulator spring biasing means 32. Each insulating disc is provided with a central aperture 34 (FIGS. 3, 4 and 5) of sufficient diameter to permit the central structural column 26 to pass freely therethrough. Additionally, each insulating disc 28 is provided with a plurality of radially aligned slots 36 (FIGS. 3, 4 and 5) equal in number to the number of conductors 14 in the element. Each slot 36 is sufficiently long and wide to permit a conductor 14 to slide freely therethrough. Spacers 30A through 30F, 40 and 46 are hollow and adapted to freely slide over central support column 26 but have outside diameters greater than the diameters of the apertures 34 of insulating discs 28, 42 and 44.

Figure 2:
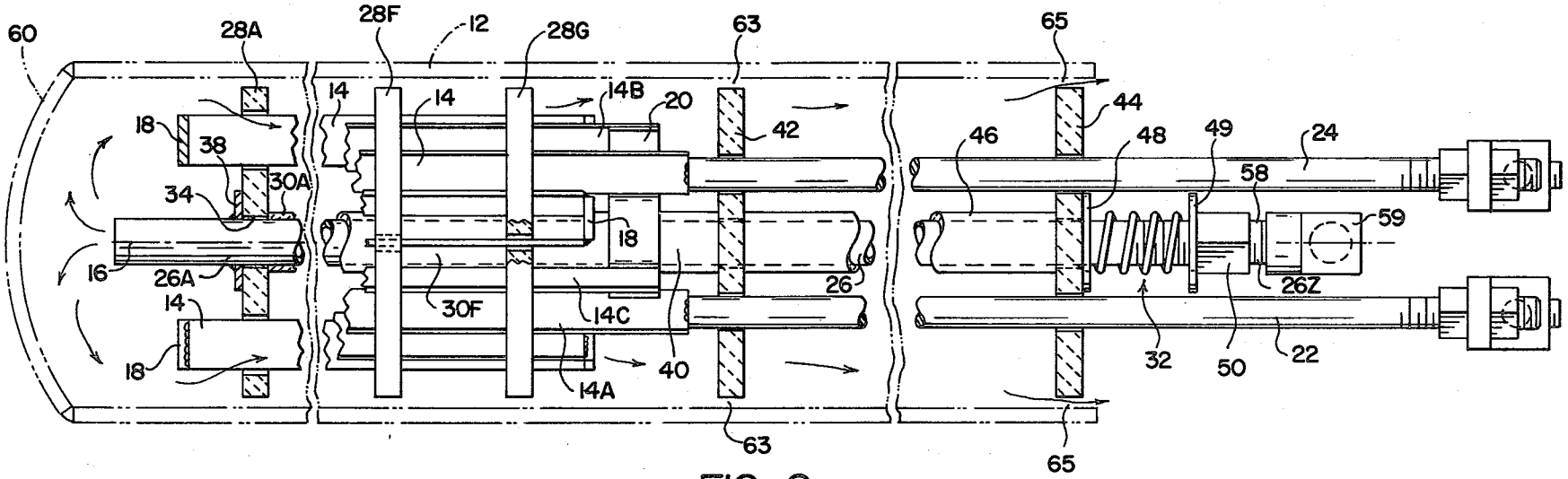
FIG. 2 is an enlarged fragmentary plan view of the invention shown in FIG. 1.

The support structure is assembled by sliding an insulating disc 28A over support column 26 until it abuts against washer 38 secured to the interior end 26A of the column 26 such as by welding (FIG. 2). Column 26 can extend beyond washer 38 sufficiently to positively prevent the interior ends of conductors 14 and jumper plates 18 from shifting into contact with radiant tube closed end 60. A spacer 30A is then positioned about support column 26 adjacent insulating disc 28A and thereafter discs 28 and spacers 30 are added alternately as required to the support column until the last conductor insulator disc 28G has been mounted on the support column 26 adjacent to disc spacer 30F. In a preferred embodiment of the invention, terminal connector rod spacers 40 and 46 and insulating discs 42 and 44 are mounted on the support column 26 to the right of the conductors 14, (FIGS. 1 and 2), for properly positioning the element axially within the radiant tube 12. Spacer 46 is generally positioned within the confines of furnace wall W. Thus, as more specifically shown in FIG. 2, a terminal rod spacer 40 is positioned between conductor insulating disc 28G and terminal rod insulating disc 42. A second terminal rod insulating disc 44 is spaced from said insulating disc 42 by terminal rod insulating spacer 46. Insulating discs 42 and 44 are provided with apertures to permit conductor rods 22 and 24, and support column 26 to freely slide therethrough. Additional apertures 62 (FIG. 1) are also provided to reduce weight and to permit movement of gas therethrough, as will be more fully explained hereinbelow. A washer 48 is provided on the exterior side of insulator disc 44 to provide bearing surface for a biasing spring 32 which is secured about support column 26 by a washer 49 and nut 50 or other standard securing device. Insulator discs and spacers are free to shift with respect to the support column 26 and the conductors 14. Biasing spring 32 urges the insulator discs and spacers into resilient contact one with the other by biasing all discs and spacers against interior insulator disc 28A. Insulator disc 28A is secured against movement to the left as shown in FIG. 1, as aforesaid, by washer 38.

Support column 26 may be solid when the element is mounted directly in a furnace and it may be hollow when the element is mounted in a radiant tube. As shown at 56 of FIGS. 3, 4 and 5, the support column is hollow and is provided with pipe threads 58 on its terminal end 26Z (FIG. 2) for connection to a pipe fitting 59, pipe nipple 61 and pump P. Pipe nipple 6 connects pump P, or other fluid supply means, to a source of suitable fluid, which may be air. The fluid is passed through the center of support column 26 under very light pressure and at a slow rate, such as 0.05 to 0.5 fpm for discharge out the interior end 26A of the support column. It is, of course, understood that this system can be reversed by substituting suction instead of pressure for moving the fluid through the support column. When the element 10 is mounted in a radiant tube 12, the closed end 60 of radiant tube 12 deflects and redirects the gas to sweep the conductors 14, and the interior surface of the radiant tube, from left to right as shown in FIGS. 1 and 2. Apertures 62 of insulator disc 42, spacing 63 between insulator disc 42 and radiant tube 12, and spacing 65 between insulator disc 44 and radiant tube 12 permit the fluid to escape to atmosphere. Repeated tests have established that introduction of a small air flow minimizes oxide deterioration of both the heating element and the radiant tube during normal operation, under both constant and cyclic temperature conditions, by permitting the proper oxide to form to protect the metal surfaces. These tests have determined that a nickel-chromium-iron alloy radiant tube exhibits catastrophic oxidation when exposed to elevated temperatures in a static air environment. The oxides formed under these conditions are loose and flaking in nature. Spalling of these oxides exposes raw metallic surfaces to the environment for further oxidation. These conditions cause accelerated metal loss through oxidation, leading to premature failure of the alloy. The conditions prevailing in an electrically heated radiant tube encourage and accelerate this type of oxidation of both the radiant tube and the electrical heating element. The oxides that form from a nickel-chromium-iron alloy are many and vary in oxygen content. With a static air environment in the radiant tube 12, formation of oxides deplete the available oxygen in the environment. The nature of the oxides will change due to this deficiency. Continued operation under these conditions causes early failure of either the heating element or the radiant tube or both.

It has been determined by testing, therefore, that accelerated oxidation can be minimized or halted by elimination of the static air environment in the radiant tube. Good results have been obtained by continuously passing air through the radiant tube 12 during operation at temperatures above ambient at a preferred rate of 3 to 25 cfh in a 7 inch diameter tube.

It will be noted that conductors 14 extend beyond insulator discs 28A and 28G an ample distance in order to provide clearance for welding conductors 14 to jumper plates 18 and for free floating expansion and contraction of the conductors. In the preferred embodiment of the element shown, with conductor insulating discs on 3" centers, extensions of the conductors approximately 1" beyond discs 28A and 28G have tested satisfactorily. Also, it will be noted that biasing spring 32 permits expansion and contraction of insulator discs 28, 42 and 44 and spacers 30, 40 and 46 independent of the expansion and contraction of conductors 14. Thus, conductors and insulators may individually respond to heating and cooling in accordance with their respective coefficients of expansion and contraction without inducing stress, or strain or inflicting damage one upon the other.

It may be undesirable in the efficient operation of a heating element to have high concentrations of heat at the opposite ends of the tube adjacent to the furnace refractory walls. Accordingly, jumper plates 18 may be arranged to have sufficient current carrying capacity that resistance is reduced between conductors 14 wherein the heat emission at the ends of the element is less than the heat emission along the longitudinal axis of the element. For this purpose jumper plates 18 are approximately twice the cross sectional thickness as the conductors 14. It is further noted that, with the fin-like radial alignment of the conductors 14, there is a minimum of interference between radiant emission between conductors. The preferred outer circumferential spacing of the radial blades is approximately 90% or greater of the blade width to maximize heat release from the surfaces of the blades.

By utilization of conductors 14, which are rectangular in cross section, resistance of the conductor may be altered without substantially changing the surface radiating capacity of the conductor wherein the mass of the conductor may be varied but its surface area will be maintained the same. Conversely, the cross sectional area of the conductor can be held constant while increasing or decreasing the surface area of the conductor. Thus, the utilization of flat strip like conductors has considerable design advantage over conductors which are circular in cross section wherein the cross sectional area and surface area of a circular conductor are both functions of the diameter of the rod.

In the present invention no insulating disc is required between the interior ends of the insulators 14 and the interior end of radiant tube 12. With a central support 26 the conductors are relieved of any support function, whereby installation of the element may be vertical without the conductors 14 being subjected to undue stress or strain. In horizontal application the conductor insulator discs 28 support the weight of the conductors to prevent excessive sagging. Thus, 3" centers have been found to be satisfactory for insulator discs with conductors approximately $\frac{1}{8}'' \times 1''$ in cross section.

Figure 8:
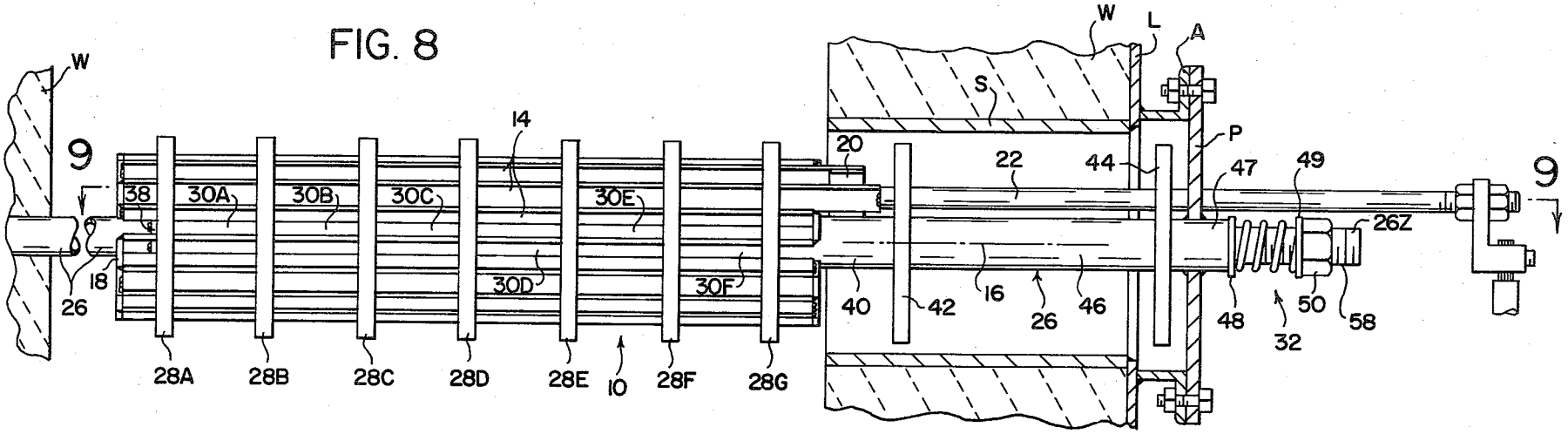
FIG. 8 is an elevational view of another preferred embodiment of the invention similar to FIG. 1 but mounted directly in a furnace without enclosure in a radiant tube.
Figure 9:
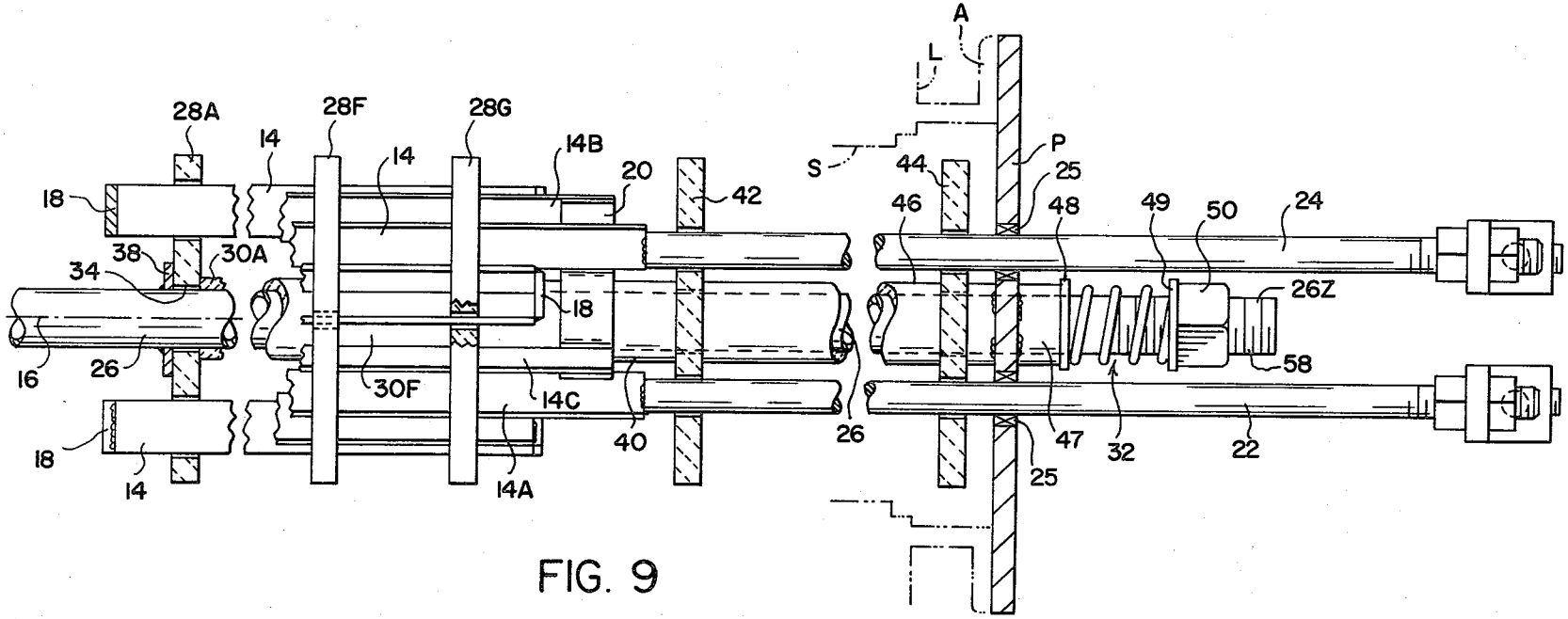
FIG. 9 is an enlarged fragmentary plan view of the invention shown in FIG. 8.

Referring to FIGS. 8 and 9, therein is shown a preferred embodiment of the heating element 10 mounted directly within the furnace rather than in a radiant tube 12 as shown in FIGS. 1 and 2. In this installation, the heating element 10 is mounted as a beam wherein the central structural support column 26 is supported at both ends in walls W of the furnace. On the right end of the support structure 26, a sleeve 47 is provided to which mounting plate P is welded. Mounting plate P is also secured to spacer angle iron frame A in the same manner as previously described with respect to FIGS. 1 and 2. Although the central structural support column 26 is shown as tubular in FIGS. 8 and 9, it also may be a solid bar inasmuch as there is no need for circulation of a non-oxidizing fluid through the support column when the element is not enclosed in a radiant tube. If the element is used in a controlled atmosphere furnace, then conductor rods 22 and 24 are brought out through mounting plate P, as best shown in FIG. 9, and are secured in mounting plate P by electrical insulators 25 which seal off conductors 22 and 24 against atmospheric leaks. In this embodiment of the invention, insulator spring biasing means 32 bears against washer 48 of support sleeve 47 to urge the central structural support column 26 outwardly to the right, thereby sandwiching together the insulators 42 and intermediate spacers 30, 40 and 46. Otherwise, the element is constructed in the same manner and comprises the same components as previously more fully described with respect to FIGS. 1 and 2.

Figure 10:
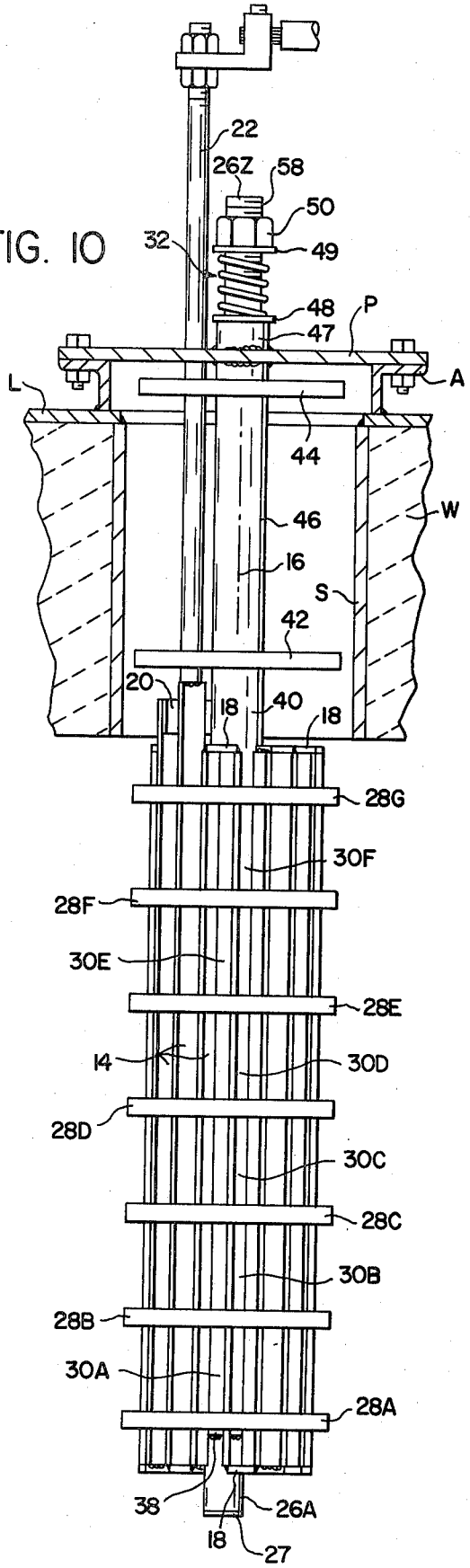
FIG. 10 is an elevational view of yet another preferred embodiment of the invention in which the element is mounted vertically in a furnace; and, FIG. 11 is a pictorial view of a modified embodiment of a conductor used in the invention.

Referring now to FIG. 10, therein is shown the heating element 10 mounted vertically in a furnace, wherein the entire weight of the element is carried by the central structural support column 26. In a controlled atmosphere installation, if the structure 26 is tubular, then a cap 27 may be secured to the lower end thereof to prevent leaking of atmosphere through the center of the column. In the alternative, the central structural support column 26 may be a solid bar in the installation as shown. However, if the vertical installation includes a radiant tube, then the central structural support column would be tubular, and means would be provided for introducing non-oxidizing fluid in the same manner as described with respect to FIGS. 1 and 2. In the vertical installation, as shown in FIG. 10, or in a radiant tube, the central structural support column 26 and conductors 14 will be in tension, whereas spacers 30, 40 and 46 will be in compression because of gravity and spring biasing means 32.

Figure 7:
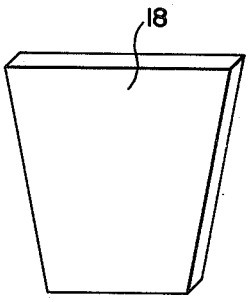
FIG. 7 is an enlarged perspective view of a trapezoidal jumper plate used to connect the ends of conductors together.
Figure 6:
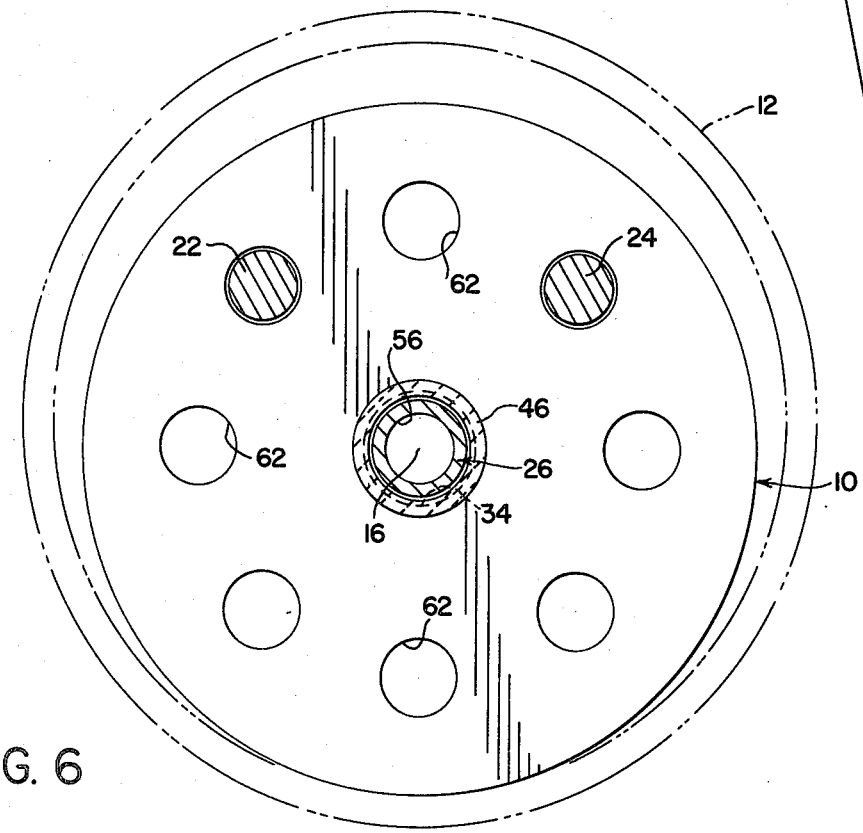
FIG. 6 is a view of the invention taken along the line 6—6 of FIG. 1.

FIG. 11 illustrates a modified form of conductor 14 in which the jumper plate 18A comprises an extension of the conductor 14. Thus, instead of welding a jumper plate 18, FIG. 7, to the ends of the conductors 14, in certain installations it is contemplated that one end of each conductor could be formed at right angles to the conductor to provide the equivalent of jumper plate 18 as shown in FIG. 11 at 18A. Thus, jumper means 18A would be integral with one conductor 14 and be welded to an adjacent conductor 14, thereby eliminating one weld in the assembly of conductors as discussed with respect to the embodiments shown in FIGS. 1 through 6.

Although preferred embodiments of the invention have been shown and described, other embodiments within the contemplation of this invention will occur to those skilled in the art upon reading the foregoing disclosure. Therefore, it is intended that the scope of this invention be limited only by the articulation of the appended claims.

Having thus described the invention, it is claimed:

1. An electric heating device in an industrial furnace for heating metal work products by radiation and for being mounted adjacent to said metal work products, said electric heating device comprising: a plurality of rigid, straight, flat, rectangular interconnected conductors of rectangular cross section having cross sectional widths substantially greater than their thicknesses, the width portions of said conductors being radially aligned and concentric about a longitudinal support member; a plurality of rigid insulator means concentric about said support member and adapted to space said conductors one from another and from said support member without substantially inhibiting radiation of heat from said conductors and without restricting expansion and contraction of said conductors relative to said insulator means and said support member, means to space said plurality of insulator means apart longitudinally along said support member and means to secure said insulator means, said spacer means and said support member to form a substantially rigid self-supporting structure through which said conductors are free to expand and contract, whereby outward radiation of heat from said device is maximized and the life of said device is prolonged.

2. The device of claim 1, wherein said device for use in a radiant tube includes a hollow central longitudinal support member; and means to flow a fluid through said support member for counterflow over said conductors and the interior surface of said radiant tube to disrupt static air, thereby minimizing destructive oxidation of said device and said radiant tube.

3. The device of claim 1, including means to vertically install said heating device wherein said conductors are placed in tension only by their own weight and said support member carries the weight of said insulators and said spacers.

4. The device of claim 1, wherein said device is for use in a radiant tube; said heating device is insertable in said radiant tube; and said central longitudinal support member projects beyond the interior ends of said conductors to prevent said conductors from making contact with the interior end of said radiant tube when said heating device is energized.

5. The device of claim 1, including means to urge said insulators into abutting contact with said spacers.

6. The device of claim 2, wherein said fluid is a non-oxidizing gas.

7. The device of claim 2, wherein said fluid is air.

8. The device of claim 1, wherein said means to permit relative movement between said conductors and said insulators are radially aligned slots in said insulators through which said conductors may freely pass.

9. The device of claim 1, wherein said means to interconnect said conductors are jumper plates secured to adjacent ends of pairs of radially aligned conductors, said plates in cross sectional area being greater than the cross sectional area of a conductor to reduce electrical resistance at the said ends of said conductors whereby heat build up at the ends of the device is minimized.

10. The device of claim 1, wherein said means to interconnect said conductors are trapezoidal jumper plates secured to adjacent ends of pairs of radially aligned conductors.

11. The device of claim 1, wherein said insulators are provided with central apertures adapted to permit said support member to freely pass therethrough.

12. The device of claim 1, wherein an insulator adjacent one end of said support member is secured against passing over said end, and means to urge inwardly an insulator on the opposite end of said support member, whereby the insulators and spacers intermediate said opposite insulators are sandwiched therebetween.

13. The device of claim 1, wherein said conductors extend sufficiently beyond the insulators on opposite ends of said device to permit expansion and contraction of said conductors without damage to said insulators.

14. The device of claim 1, wherein said insulators are spaced sufficiently close together to prevent sagging of said conductors when said device is mounted horizontally.

15. The device of claim 1, wherein said insulators are circular with central apertures to freely receive said support member therethrough and with radial slots to freely receive said conductors therethrough.

16. The device of claim 1, wherein said spacers are cylindrical sleeves adapted to freely fit concentrically around said central structural member.

17. The device of claim 1, wherein said means to connect said conductors are low resistance jumper means, whereby heat generation at the ends of said device is minimized.

18. An electric heating device comprising: a plurality of rigid, elongated, flat, rectangular conductors having rectangular cross sections with cross sectional widths substantially greater than the cross sectional thicknesses a plurality of insulators positioned axially along said conductor adapted to mechanically align said conductors about a central longitudinal axis with the cross sectional widths of said flat conductors in radial alignment with said central longitudinal axis; apertures in said insulators to permit free relative shifting between said conductors and said insulators; tubular spacer means positioned between insulators; low electrical resistance connector plate means to interconnect said conductors; a central tubular structural member positioned concentric with said central longitudinal axis and within said tubular spacers adapted to support said insulators and said spacers in tandem alignment, and means to flow a fluid suitable for retarding oxidation over said conductors to disrupt static air surrounding said conductors thereby minimizing destructive oxidation of said device.

19. The electric heating device of claim 18, including means to flow said fluid over said conductors at substantially a rate of from 3 to 25 cfh.

20. The electric heating device of claim 18, including means to flow said fluid over said conductors at substantially a rate of from 0.05 to 0.5 fpm.

21. The electric heating device of claim 18, including a source of non-oxidizing fluid for flowing over said conductors.

22. The electric heating device of claim 18, including a source of air to flow over said conductors.

23. The electric heating device of claim 18, including means to force said fluid through said tubular structural member.

24. The electric heating device of claim 1, wherein the outer circumferential spacing between the outside longitudinal edges of said radially aligned conductors is substantially within a range from 50% to 500% of the conductor width to maximize heat release from the surfaces of the conductors.

25. THe electric heating device of claim 1, wherein the outer circumferential spacing between the outside longitudinal edges of said radially aligned conductors is substantially 90% of the conductor width to maximize heat release from the surfaces of the conductors.

26. The electric heating device of claim 18, wherein the outer circumferential spacing between the outside longitudinal edges of said radially aligned conductors is substantially within a range from 50% to 500% of the conductor width to maximize heat release from the surfaces of the conductors.

27. The electric heating device of claim 18, wherein the outer circumferential spacing between the outside longitudinal edges of said radially aligned conductors is substantially 90% of the conductor width to maximize heat release from the surfaces of the conductors.

* * * * *

UNITED STATES PATENT AND TRADEMARK OFFICE

CERTIFICATE OF CORRECTION

PATENT NO. : 4,179,603

DATED : December 18, 1979

INVENTOR(S) : Jon G. Ziegler, Elmer L. Kerr, David V. Bell

It is certified that error appears in the above-identified patent and that said Letters Patent are hereby corrected as shown below:

In the drawings, Sheet 1, Fig. 2, the reference numeral "14" appearing between insulator discs 28F and 28G and denoting the conductor extending from terminal connector rod 24 should read -- 14F --; Column 2, line 44, cancel "to provide a support structure member"; Column 3, line 37, reference numeral "18a" should read -- 18A --; Column 6, line 50, after reference numeral "42" insert --, 44, insulator discs 28, --; Column 8, line 54, after "thicknesses" insert a semi-colon (;).

Signed and Sealed this

*Thirteenth* Day of *May 1980*

[SEAL]

*Attest:*

SIDNEY A. DIAMOND

*Attesting Officer*

*Commissioner of Patents and Trademarks*